United States Patent [19]

Singhal

[11] Patent Number: 4,602,948

[45] Date of Patent: Jul. 29, 1986

[54] PRODUCTION OF AN IRON-BORON-SILICON-CARBON COMPOSITION UTILIZING CARBON REDUCTION

[75] Inventor: Subhash C. Singhal, Murrysville Boro, Pa.

[73] Assignee: Westinghouse Electric Corp., Pittsburgh, Pa.

[21] Appl. No.: 775,205

[22] Filed: Sep. 12, 1985

[51] Int. Cl.[4] ..... C22C 33/00

[52] U.S. Cl. ..... 75/129; 75/123 B; 75/123 L

[58] Field of Search ..... 75/129, 123 B, 123 L

[56] References Cited

U.S. PATENT DOCUMENTS

| | | | |
|---|---|---|---|
| 4,397,691 | 8/1983 | Hamada | 75/123 B |
| 4,440,568 | 4/1984 | Staggers | 75/129 |
| 4,486,226 | 12/1984 | Hildebrand | 75/129 |
| 4,509,976 | 4/1985 | Zambrano | 75/129 |
| 4,536,215 | 8/1985 | Coad | 75/129 |

*Primary Examiner*—Peter D. Rosenberg

*Attorney, Agent, or Firm*—R. D. Fuerle

[57] ABSTRACT

This is a process for producing an iron-boron-silicon-carbon composition for use in magnetic amorphous alloys. This process utilizes the carbon reduction of boric acid and avoids the use of expensive ferroboron as an ingredient. It also results in an alloy which is substantially free from aluminum. The process uses a mixture of iron-containing constituent, silicon-containing constituent, carbon-containing constituent and boric acid. Only 1–2 times the stoichiometric boron-containing amount of boric acid is required. The iron constituent is preferably selected from iron, ferrosilicon, carbon-containing iron, and mixtures thereof. The silicon content is preferably selected from the silicon, ferrosilicon, and mixtures thereof. The carbon constituent is preferably selected from the group consisting of carbon, carbon in iron, and mixtures thereof. The boric acid is lanced into the bottom of a molten pool which generally contains the other constituents. Preferably, carbon is mixed with the boric acid, and the combination lanced into the bottom of the molten pool such that the carbon reduction reaction can take place in the 1525°–1575° C. temperature range.

12 Claims, No Drawings

PRODUCTION OF AN IRON-BORON-SILICON-CARBON COMPOSITION UTILIZING CARBON REDUCTION

CROSS-REFERENCE TO RELATED APPLICATIONS

A method for producing such an alloy by means of silicon reduction is described in related application Ser. No. 775,075 assigned to the same assignee. Although the end product is the same, the process of that related case uses silicon reduction, rather than carbon reduction as in the instant invention.

A method of making ferroboron is described in related application Ser. No. 775,074 assigned to the same assignee. Like the aforementioned related application, this related application uses silicon reduction, but makes ferroboron, rather than the final alloy.

BACKGROUND OF THE INVENTION

The present invention relates to a process for making amorphous alloys (either directly or by making a master alloy for use in ultimately making the amorphous alloy) such are intended, for exmaple, to at least partially replace crystalline electrical steels in transformer. In particular, this invention relates to a method for making amorphous alloys which avoids the use of expensive ferroboron.

Amorphous alloy of iron-3% boron-5% silicon and up to 1.0% carbon (and typically containing about 0.5% carbon ) has been suggested for a number of magnetic applications, such as in motors and transformers. This alloy has been relatively expensive, however, principally due to the cost of boron. The boron content typically has been added in the form of ferroboron which has been prepared by carbon reduction of a mixture of $B_2O_3$, steel scrap, and/or iron oxide (mill scale). That process for making ferroboron is highly endothermic and is carried out in submerged electrode arc furnaces. The reduction requires temperatures of about 1600°-1800° C., and the boron recovery is low (typically only about 40% and thus about 2.5 times the final amount of boron must be added) due to the very high vapor pressure of $B_2O_3$ at such high reaction temperatures. Furthermore, large amounts of carbon monoxide gas are evolved during the process, necessitating extensive pollution control. Low recovery of boron and the use of extensive pollution control equipment result in a high cost of converting $B_2O_3$ (anhydrous boric acid) into ferroboron (ferroboron typically costs more than five times as much as boric acid per pound of contained boron).

Although boric acid can be reduced by an aluminothermic process, such a process produces ferroboron with about 4% aluminum (percentages as used herein, are weight percents), which is unsuitable for use in such magnetic applications.

SUMMARY OF THE INVENTION

This is a process for producing a substantially aluminum-free iron-boron-silicon alloy (as used herein, the term "iron-boron-silicon alloy" means an iron-3% boron-5% silicon alloy which also contains 0.05-1.0% carbon). Anhydrous boric acid ($B_2O_3$) is reduced principally by carbon in this process. The process comprises preparing a mixture consisting essentailly of an essentially stoichiometric-iron containing iron constituent and an essentially 1-1.6 times (and preferably about 1 times) stoichiometric-silicon containing a silicon constituent and heating the mixture to produce a molten pool. A carbon constituent is added before heating, during heating, or after heating or combinations thereof. Excess carbon is provided in the molten pool. Between one and two times the stoichiometric amount of boron containing boric acid is lanced into the bottom of the molten pool to produce a molten iron-boron-silicon-carbon composition. Because the boric acid is introduced into the bottom of the molten pool and because the excess carbon is available in the pool for reduction of the boric acid, the loss of boron through boric acid volatilizing from the molten pool is minimized. The composition of the pool can be monitored and any of the constituents can be added to adjust the final composition even after the boron has been added.

Preferably, the iron containing constituent is selected from the group consisting of iron, ferrosilicon, and mixtures thereof and the silicon constituent is selected from silicon, ferrosilicon, and mixtures thereof, and the carbon constituent is selected from carbon, carbon in iron, and mixtures thereof. The molten pool is to be maintained at a temperature of less than 1600° C. and preferably is maintained at a temperature of between 1525° C. and 1575° C.

The combination of a lower temperature of the molten pool and the reduction of the boric acid at the relatively dilute concentration of the final alloy, avoids the use of expensive ferroboron and minimizes the loss of boron through the volatilization of $B_2O_3$.

DESCRIPTION OF THE PREFERRED EMBODIMENTS

In this invention, $B_2O_3$ (boric acid, as a dry power, preferably anhydrous technical grade) is reduced by carbon in a pool of molten iron (preferably at a temperature of 1525°-1575° C.) to produce the desired iron-boron-silicon (and carbon) alloy composition. The reaction of carbon and boric acid, according to the following reaction is thermodynamically favored at temperatures above about 1525° C. and little or no external heat is required:

$$B_2O_3+3C \rightarrow 2B+3CO$$

The carbon monoxide bubbled off as a gas, leaving the boron in the molten pool. The reaction can be carried out in an electric furnace to assure that temperature control can be maintained. The boric acid can be injected with an inert carrier gas which can be preheated.

The silicon may be added either as ferrosilicon or silicon metal or mixtures thereof. The iron may be added as iron (including, for example, pig iron), ferrosilicon, and mixtures thereof. The carbon may be added as carbon, carbon in iron (e.g. in pig iron) or as mixtures thereof. Other compounds that add these constituents, but which do not change the final alloy could also be used, but the foregoing are thought to be the most practical.

Although the reduction of boron oxide is principally by carbon at these temperatures and compositions, it should be noted that silicon can also react with the boric acid (as well as with other oxygen in the mixture). Thus the combined amount of silicon and carbon in the mixture is preferably about 5-6% more than will be used in the reactions forming carbon monoxide (and possibly some carbon dioxide, especially as carbon can react with other oxygen in the mixture) and silicon dioxide with the amount of oxygen in the mixture. Any silicon dioxide formed will create a slag on the surface and can be easily removed.

The boric acid and carbon can be conveniently mixed externally and, by means of an inert carrier gas, be lanced into the bottom of the molten pool. Such an arrangement creates locally high carbon concentrations and helps to assure that the reduction is primarily by carbon, especially at the lower end of the 1525°–1575° C. operating range. Again, an analysis can be made of the molten pool and adjustments to the chemistry made by additions of constituents. These adjustments are especially convenient as the loss of boron by volatilization of $B_2O_3$ as well as the ratio of carbon monoxide to carbon dioxide formed are quite dependent on furnace configuration, ingredients, and the exact procedure utilized.

All constituents should be substantially aluminum free as aluminum adversely affects the performance of the composition as an amorphous magnetic material. As is well known, rapid solidification is required to produce an alloy in amorphous form. This can be done either directly from the melt, or by allowing the melt to solidify for intermediate storage with remelting and rapid solidification performed at a later time. Preferably, an initial mixture is made of iron, carbon in iron, and silicon, and the mixture is heated to produce a molten pool. Preferably, carbon is also lanced into the molten pool along with boric acid, using an inert carrier gas. By premixing the carbon and the boric acid, the process can be operated in the preferred 1525°–1575° C. temperature range.

The foregoing description of the invention is to be regarded as illustrative rather than restrictive. The invention is intended to cover all processes which do not depart from the spirit and scope of the invention.

I claim:

1. A process for producing an iron-about 3% boron-about 5% silicon amorphous alloy containing about 0.05 to 1.0% carbon, said process comprising:

a. preparing a mixture consisting essentially of an essentially stoichiometric-iron containing iron constituent, and an essentially 1 to 1.6 times stoichiometric-silicon containing silicon constituent, siad iron constituent being selected from the group consisting of iron, ferrosilicon, and mixtures thereof, and said silicon constituent being selected from the group consisting of silicon, ferrosilicon, and mixtures thereof;

b. heating said mixture and adding a carbon constituent, said carbon constituent being selected from the group consisting of carbon, carbon in iron and mixtures thereof, with the amount of carbon being about 0.05 to 1.0% in excess of stoichiometric for the formation of carbon monoxide with the total amount of oxygen in said mixture plus the amount of oxygen in stoichiometric-boron containing boric acid, to produce a molten pool of iron-silicon-carbon, with the adding of the carbon being before heating, during heating or after heating or combinations thereof;

c. controlling the molten pool to a temperature of 1525° to 1575° C.; and d. injecting a between one and two times stoichiometric-boron containing amount of boric acid into the bottom of said molten pool to produce molten iron-boron-silicon, whereby the boron oxide of the boric acid is generally retained in the molten pool and reduced by the carbon and the loss of boron is minimized.

2. The process of claim 1, wherein said mixture is of iron, carbon in iron, and silicon.

3. The process of claim 1, wherein at least some of the carbon is injected into said molten pool along with said boric acid and said molten pool is at a temperature of 1525° to 1575° C.

4. The process of claim 1, wherein after at least some of the boric acid is injected, a chemical analysis of said molten pool is performed and at least one chemistry adjusting addition is made to produce an iron-about 3% boron-about 5% silicon-about 0.05 to 1.0% carbon alloy.

5. A process for producing an iron-about 3% boron-about 5% silicon amorphous alloy containing about 0.05 to 1.0% carbon, said process comprising:

a. preparing a mixture consisting essentally of an essentially stoichiometric-iron containing iron constituent, an essentially stoichiometric-silicon containing silicon constituent, and a carbon constituent, said iron constituent being selected from the group consisting of iron, ferrosilicon, and mixtures thereof, and said silicon constituent being selected from the group consisting of silicon, ferrosilicon, and mixtures thereof, and said carbon constituent being selected from the group consisting of carbon, carbon in iron and mixtures thereof, with the amount of carbon in said mixture being about 0.05 to 1.0% in excess of stoichiometric for the formation of carbon monoxide with the total of the amount of oxygen in said mixture plus the amount of oxygen in stoichiometric-boron containing boric acid;

b. heating said mixture to produce a molten pool of iron-silicon-carbon;

c. injecting a between once and twice stoichiometric-boron containing amount of boric acid into the bottom of said molten pool to produce molten iron-boron-silicon, whereby the boron oxide of the boric acid is generally retained in the molten pool and reduced by the carbon and the loss of boron is minimized; and d. rapidly solidifying said molten iron-boron-silicon to produce an amorphous iron-about 3% boron-about 5% silicon alloy.

6. The process of claim 5, wherein said mixture is of iron, carbon in iron, and silicon.

7. The process of claim 1, wherein said mixture is heated in an electric furnace.

8. The process of claim 1, wherein the combined amount of silicon and carbon in said mixture is about 5 to about 6% more than is used in reactions forming oxides of carbon and silicon.

9. The process of claim 1, wherein all of said constituents are substantially aluminum free.

10. The process of claim 5, wherein said mixture is heated in an electric furnace.

11. The process of claim 5, wherein the combined amount of silicon and carbon in said mixture is about 5 to about 6% more than is used in reactions forming oxides of carbon and silicon.

12. The process of claim 5, wherein all of said constituents are substantially aluminum free.

* * * * *